United States Patent [19]

Fern

[11] Patent Number: 4,497,594

[45] Date of Patent: Feb. 5, 1985

[54] OFFSHORE STRUCTURE AND METHOD OF SINKING SAME

[75] Inventor: Derek T. Fern, Gretna, La.

[73] Assignee: McDermott Incorporated, New Orleans, La.

[21] Appl. No.: 429,895

[22] Filed: Sep. 30, 1982

[51] Int. Cl.[3] ..... E02B 17/00

[52] U.S. Cl. ..... 405/217; 405/203; 405/204

[58] Field of Search ..... 405/203, 205–209, 405/224, 227

[56] References Cited

U.S. PATENT DOCUMENTS

| | | | |
|---|---|---|---|
| 2,897,654 | 8/1959 | Harris | 405/205 |
| 3,347,052 | 10/1967 | Steitle et al. | 405/205 |
| 3,754,403 | 8/1973 | Mott et al. | 405/208 |
| 4,337,010 | 6/1982 | Sullaway et al. | 405/227 |

FOREIGN PATENT DOCUMENTS

| | | | |
|---|---|---|---|
| 2018700 | 10/1979 | United Kingdom | 405/205 |
| 2028403 | 3/1980 | United Kingdom | 405/203 |

*Primary Examiner*—Dennis L. Taylor

*Attorney, Agent, or Firm*—Robert J. Edwards; James C. Simmons

[57] ABSTRACT

An offshore structure and a method of sinking it to the sea bed. In accordance with one aspect of this invention, the structure is sunk asymmetrically by first sinking a first end portion thereof and then sinking the other end portion. The first end portion is sunk by ballasting it while the other end portion is closed to ballast. The structure is provided with sufficient water plane area while sinking each end portion to maintain stability during the sinking process. In accordance with another aspect of this invention, at least two spaced-apart piles are provided at the end corresponding to the first end portion to absorb the force of impact with the sea bed and to maintain a skirt on the structure out of contact with the sea bed until both ends of the structure have been sunk to the sea bed.

18 Claims, 14 Drawing Figures

OFFSHORE STRUCTURE AND METHOD OF SINKING SAME

This invention is related to the field of offshore structures and to methods of sinking them to the sea bed.

The cold regions of the world (those regions near the Arctic and Antarctic) are considered to be rich sources of hydrocarbons. Although many areas of these regions have been explored and some are already being developed, a considerable amount of additional exploration and development remains to be done. Because the locations for such exploration and development are remote and the climate at these locations is severe, the construction of offshore ice-resistant platforms can be expensive and time consuming if it is required that such construction be performed at these locations. It is thus considered desirable for exploration and development of these regions that complete platforms be built and tested in more civilized areas, floated and towed to the respective locations in which they are to be used, and then sunk onto the sea bed.

Present procedures for installing such structures on the sea bed are not as satisfactory as desired. Ballasting such a structure having a rectangular base and a central column for sinking thereof symmetrically may cause the platform to lose stability as the water plane area changes from that of the rectangular base to that of the central column as the base is submerged. In addition to being expensive, deck winch operated massive anchor blocks used to "pull down" a structure in a level mode still require careful control during ballasting of the structure. Thus, loss of control during the sinking process is not unlikely with these present procedures. Since a platform with its load of expensive machinery and equipment typically may weigh as much as 16,000 tons, it is very critical that it not be allowed to get out of control. In other words, it is very desirable that such a structure be stable throughout the sinking thereof so that it may be controlled from accelerating rapidly into the sea bed.

Anti-aircraft defense forts were installed in estuary waters around the British coast during World War II by allowing concrete structures to free flood and sink onto the sea bed. These structures were allowed to tilt such that one end touched the sea bed first. However, once started, the sinking of these forts did not provide for control of their stability or for reversing the process. As a result, the speed of descent to the sea bottom could not be reduced and a fort would impact with the sea bottom with great force. Reinforced concrete "buffers" were provided to crush upon impact of a fort with the sea bed.

It is an object of the present invention to provide an offshore drilling and/or production platform which can be installed in a single piece to thus minimize offshore construction time.

It is another object of the present invention to provide a method of controllably sinking such a structure to the sea bed.

It is a further object of the present invention to provide a means for protecting the skirt of the platform during the sinking process.

The above and other objects, features, and advantages of this invention will be apparent in the following detailed description of the preferred embodiments thereof which is to be read in connection with the accompanying drawings.

IN THE DRAWINGS

Figure 1:
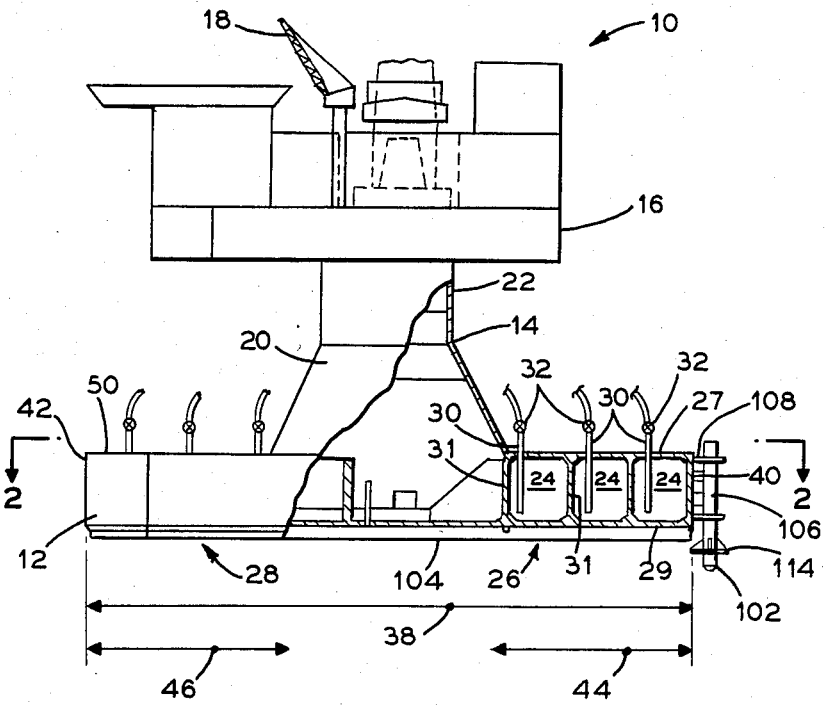
FIG. 1 is a side elevation view with portions broken away of a structure embodying the present invention.
Figure 2:
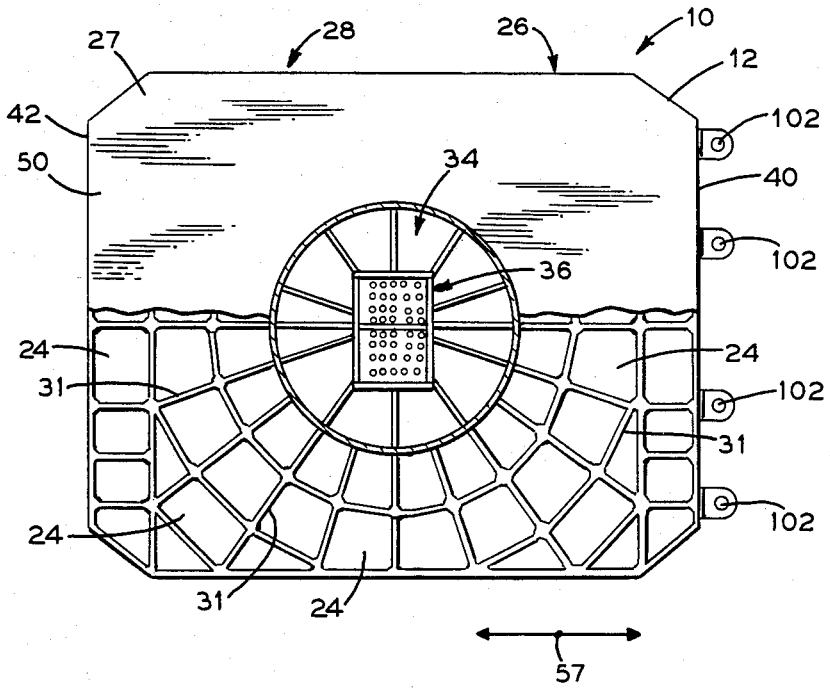
FIG. 2 is a view with portions broken away taken along lines 2—2 of FIG. 1.

Referring now to the drawings, FIGS. 1 and 2 represent a marine structure generally indicated at 10 for installation in a body of water. This structure 10 is provided with a shallow reinforced concrete rectangular raft or base 12 which supports at the center a column 14 which carries on top a steel box 16 containing various drilling and production machinery and facilities such as the crane illustrated at 18. The column is conical over its lower portion 20 and cylindrical over its upper portion 22. This invention, however, is not restricted to such offshore structures, but is suitable for any type of marine structure which it is desired to sink to the sea bed in a controlled manner.

The base 12 of the structure is provided with a plurality of compartments 24 formed by upper and lower horizontally extending members 27 and 29 respectively which are connected by vertically extending members 31. These compartments 24 may be filled with seawater or other ballast material for ballasting thereof or emptied of ballast for deballasting thereof. A drill-way 36 is provided vertically through generally the center of the base 12. The drill-way 36 may be surrounded in the base by spaces such as diesel tanks 34 for storage purposes. Means are provided, in accordance with one aspect of the present invention, for closing one end portion such as the end portion illustrated at 28 to ballast, while ballasting the other end portion illustrated at 26, so that the structure 10 may be sunk to the sea bed asymmetrically by first sinking the end portion 26 to the sea bed after which the end portion 28 is ballasted for its sinking to the sea bed. Such means preferably comprise an individual ballasting and deballasting line and valve illustrated at 30 and 32 respectively for each individual compartment 24, and each compartment 24 being sealed to the flow of ballast to or from any other compartment. Although it is preferred that the base portion 12 be provided with a plurality of individual compartments 24 which may be separately ballasted and which are closed to the flow of ballast from other compartments so as to maximize the amount of control which the operator may have on the ballasting process for sinking of the structure 10 to the sea bed, the present invention does not require a plurality of individual compartments on either end portion of the structure 10 or that an individual compartment on one end portion of the structure be closed to the flow of ballast from another individual compartment on the same end portion. For the purposes of this specification and the claims, an end portion is defined as having a width equal to one-third of the distance 38 between the respective ends 40 and 42. The width of end portion 26 is illustrated at 44, and the width of end portion 28 is illustrated at 46.

Figure 3:
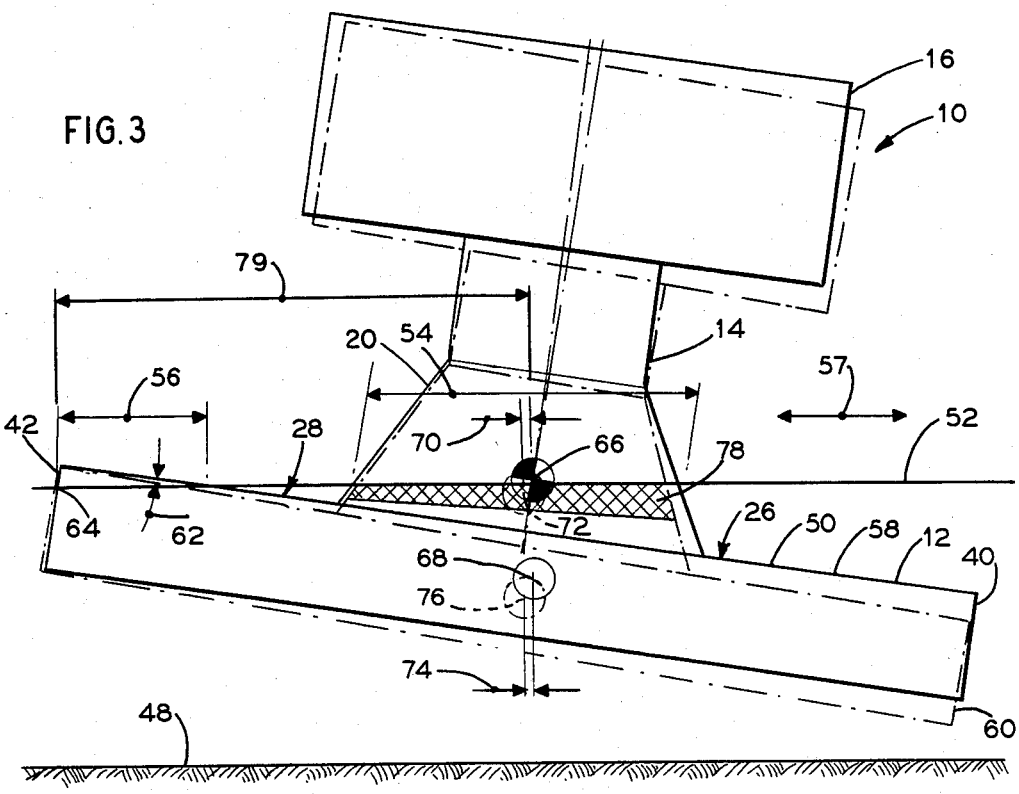
FIGS. 3 and 4 are schematics illustrating calculations of stability during sinking of the structure to the sea bed in accordance with the present invention.
Figure 4:
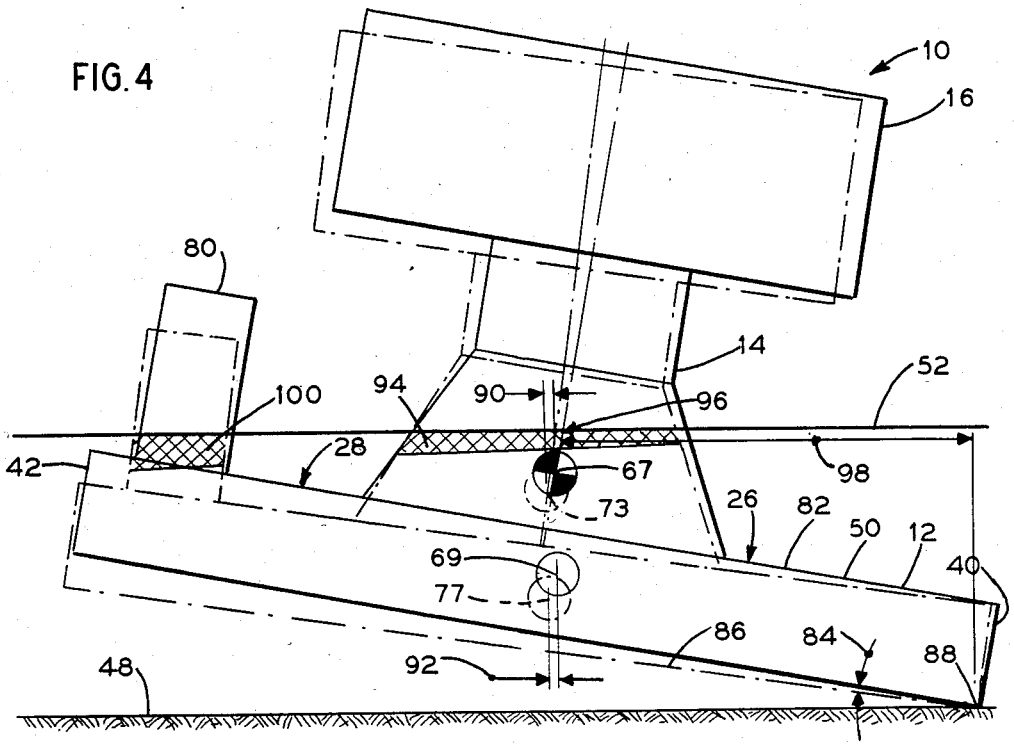

FIGS. 3 and 4 illustrate the principles used to calculate and achieve stability of such a structure at various positions throughout the sinking process thereof in accordance with the present invention. These figures illustrate an asymmetrical ballasting and sinking of the structure 10 to the sea bed illustrated at 48 wherein the end portion 26 (hereinafter called first end portion) is sunk to the sea bed 48 as illustrated in FIG. 3 after which the opposite end portion 28 (hereinafter called second end portion) is ballasted and sunk to the sea bed 48 as illustrated in FIG. 4.

At the beginning of the sinking process of the first end portion 26, as the first end portion 26 is being initially ballasted, substantially the entire upper horizontal surface 50 of the base portion 12 is above the surface illustrated at 52 of the sea thus providing a water plane area substantially equal to the entire area of the upper surface 50 of the base portion, and the structure 10 should, of course, be stable at the beginning of the sinking process. For the purposes of this specification and the claims, "water plane" refers to the plane defined by the surface of a body of water in which a structure is floating, and "water plane area" of a structure floating in the body of water refers to the area or areas of a water plane portion bounded by the points of intersection of the surface of the body of water with the structure. As the first end portion 26 is sunk below the sea surface 52 to the position illustrated in solid lines in FIG. 3, the water plane area of the structure 10 is decreased substantially so that its water plane area extends in a lengthwise direction only over the distance illustrated at 54 provided by the conical section 20 breaking the sea surface and over the distance illustrated at 56 provided by the opposite end portion 28 breaking the sea surface. By "lengthwise direction" is meant a direction, as illustrated at 57, along a straight line between two ends of a structure whose end portions are to be successively sunk.

It is desirable in accordance with this invention that the structure 10 have stability at the positions shown in FIGS. 3 and 4 as well as throughout the sinking process in order to maintain effective control over positioning of the structure 10 on the sea bed 48 and to prevent damage to the platform 10 and its equipment which damage may otherwise result if the speed of descent of the structure were uncontrolled and the forces of impact with the sea bed were consequently excessive. For the purposes of this specification and the claims, "stability" of a structure is the tendency of the structure to return to its original position in a body of water after it has been inclined due to external forces. Whether or not a vessel or structure is stable at a particular position is dependent upon the location of the center of gravity and the location of the center of buoyancy at that position. FIG. 3 illustrates the structure 10 in a first position in solid line at 58 and in a second position in dot-and-dashed line at 60 superimposed thereon for ease of illustration wherein the vessel or structure 10 has been inclined at a small angle illustrated at 62 from the first position. The first position 58 illustrates an actual position to which the structure 10 has been ballasted. The second position 60 illustrates an assumed deflection of the structure 10 by about 2 degrees about an assumed pivot point illustrated at 64 at or near the second end 42 of the structure. If the structure 10 has stability at the first position 58, it will return from the second position 60 to the first position 58 upon removal of forces deflecting it to the second position 60. On the other hand, if the structure 10 were unstable at the first position 58, then a deflection of the structure 10 to the second position may result in the structure remaining at the second position 60 upon removal of forces deflecting it to the second position 60 or in the structure deflecting to a greater extent without the application of any additional external forces.

When the structure 10 is in the first position 58, the location of its center of gravity is illustrated at 66 and the location of its center of buoyancy is illustrated at 68. When the structure 10 has been deflected through a small angle 62 to the second position 60 in FIG. 3, although the mass of the structure 10 remains the same, the center of gravity has been displaced in a lengthwise direction 57 toward the pivot point 64 a distance illustrated at 70 to the location illustrated at 72. However, it should be realized that, under some platform weight distributions, the location of the center of gravity may be displaced away from pivot point 64. The center of buoyancy of the original water displacement at first position 58 has been displaced in a lengthwise direction 57 toward the pivot point 64 a distance illustrated at 74 to the location illustrated at 76. In addition, there is an additional water displacement illustrated by the cross-hatched portion 78 which results in additional buoyancy which has a moment arm (from the assumed pivot point 64) illustrated at 79. Whether or not the structure 10 has stability at the first position 58 in FIG. 3 can be determined, in accordance with the present invention, by calculating the restoring moment due to the additional water displaced by shaded portion 78 upon deflection of the structure 10 through the small angle 62 and comparing this calculated restoring moment with the respective changes in mass and buoyancy (of original water displacement at first position 58) moments due to their lengthwise displacements 70 and 74 respectively. In other words, taking moments about pivot point 64, for the structure 10 to have stability at the first position 58, the amount of decrease in the buoyancy moment due to the lengthwise displacement 74 of the center of buoyancy of the original water displacement at first position 58 toward the pivot point 64 must be less than the moment due to the additional displacement of water at shaded portion 78 less the amount of decrease in the mass moment due to the lengthwise displacement 70 of the center of gravity toward the pivot point 64. These calculations can be made using engineering principles of common knowledge to those of ordinary skill in the art to which this invention pertains. The term "small angle" is a term of art which is of common knowledge to those of ordinary skill in the art to which this invention pertains. It is of common knowledge to those of ordinary skill in the art to which this invention pertains that stability calculations are valid for a "small angle" up to about 3 or 4 degrees of deflection after which the validity of the calculations becomes doubtful.

In order to insure stability of the structure 10 throughout the process of sinking both end portions 26 and 28 thereof to the sea bed 48, the stability of the structure 10 is preferably calculated, prior to sinking thereof, for a series of positions of the structure 10 in the range over which it is to be sunk. If desired, a graph may then be plotted to further verify that there is stability throughout the entire sinking process.

FIG. 4 illustrates the structure 10 after the first end portion 26 has been sunk to the sea bed 48 and during the sinking of the second end portion 28. In this drawing, what will be referred to herein as a buoyancy member, illustrated at 80, has been attached to the second end portion 28. A buoyancy member may be characterized as a member which is closed to the flow of sea water during a stage of sinking of a structure to which it is attached in order to provide increased buoyancy of the structure during that stage of sinking. Whether or not one or more buoyancy members should be added to the structure depends upon whether, during the series of calculations over the range of sinking positions of the second portion, instability is indicated at any of those positions. For example, the calculations may be conducted for the position of the structure 10 illustrated in solid line at 82 (another actual position of the structure which will also be called a "first position") in FIG. 4 to determine whether or not the structure 10 has stability when it is in that position 82 without the buoyancy member 80 attached to the structure 10 by comparing the changes in buoyancy and mass moments when the structure is deflected through the small angle indicated at 84 to the dot-and-dashed line position illustrated at 86 (another assumed deflected position which will also be called a "second position") in a similar manner to the manner in which the calculations described for the first position 58 of FIG. 3 are made. In this case, the pivot point for the deflection through the small angle is the point illustrated at 88 at which the first end 40 touches the sea bed 48. In this case, the center of gravity, shown at 67 when the structure is in first position 82 and at 73 when the structure is in second position 86, has been displaced in the lengthwise direction 57 away from the pivot point 88 a distance illustrated at 90, and the center of buoyancy of the original water displacement at first position 82, shown at 69 when the structure is in first position 82 and at 77 when the structure 10 is in second position 86, has been displaced in the lengthwise direction 57 away from the pivot point 88 a distance illustrated at 92. When the structure is in second position 86, there is also an additional displacement of water indicated by the cross-hatched area illustrated at 94 whose center of buoyancy is indicated at 96 and whose distance (moment arm) of the center of buoyancy 96 from the pivot point 88 is indicated at 98. For the structure 10 to have stability without the buoyancy member 80 attached thereto, the amount of increase in mass moment due to the increased lengthwise distance 90 of the center of gravity from the pivot point 88 must be less than the amount of increase in the buoyancy moment due to the increased lengthwise distance 92 of the center of buoyancy of the original water displacement when the structure is in first position 82 from the pivot point 88 plus the buoyancy moment due to the additional water displacement of the shaded portion 94. If the calculation indicates instability at the first position 82, then in accordance with this invention, one or more buoyancy members such as the buoyancy member 80 are attached to the structure 10 to provide additional water displacement at locations which are preferably distant from the pivot point 88 in order to maximize the resulting additional buoyancy moment. With the buoyancy member on the second end portion 28 (preferably close to the end 42 so as to be as far from pivot point 88 as practical), the changes in buoyancy and mass moments may again be calculated to determine whether or not there is stability at the first position 82. In this case, the amount of increase in mass moment due to the increased distance 90 of the center of gravity from the pivot point 88 must be less than the amount of increase in buoyancy moment due to the increased distance 92 of the center of buoyancy of the original water displacement at the first position 82 from the pivot point 88 plus the buoyancy moment due to the added water displacement provided by the portion 94 plus the buoyancy moment due to the added water displacement provided by the buoyancy member 80 as illustrated by the cross-hatched portion 100 thereof.

In order to maintain stability throughout the remainder of the sinking of an end portion once it has been determined that a buoyancy member 80 is required, it is preferred that the buoyancy member 80 have sufficient height when attached to the structure 10 to break to sea surface 52 when the structure 10 has been sunk to the sea bed 48 so that sufficient additional buoyancy is provided throughout the sinking process.

The above described stability calculations and additions of buoyancy members as required are continued in accordance with this invention until the calculated increases in restoring moments are greater than the respective increases in mass moments throughout the range of sinking positions of the structure. As previously stated, the various stability calculations which are described herein may be conducted utilizing engineering principles of common knowledge to those of ordinary skill in the art to which this invention pertains.

FIGS. 5 through 10 illustrate in consecutive stages the sinking in a controlled manner in accordance with the present invention of the structure 10 to the sea bed 48. It is expected that most conventional offshore platforms are of such a size that they may be tilted to an angle of about 12 to 15 degrees in a controllable and reversible process in accordance with the present invention in water depths up to approximately 150 feet. However, since the angle and water depth are dependent upon the size and shape of a structure to be sunk, the present invention should not be construed as being limited to such angles or such water depths.

Figure 5:
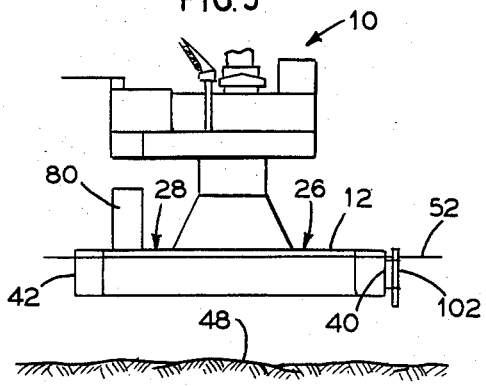
FIGS. 5 through 10 are schematics illustrating consecutively the stages of sinking of the structure to the sea bed in accordance with the present invention.
Figure 9:
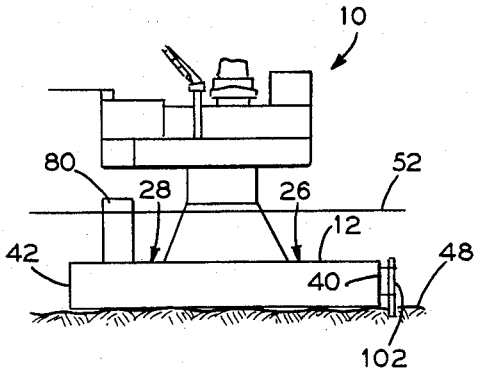

FIG. 5 illustrates the offshore platform 10 in position for transport to a location where it is to be sunk or in position above a location where it is to be sunk. Prior to sinking of the structure 10, stability calculations should be conducted and the structure 10 provided with sufficient water plane area to maintain stability during the sinking of each end portion to the sea bed 48 in accordance with the procedures discussed above. In accordance with such procedures, it may be determined for the platform 10 illustrated in FIG. 5 that additional water plane area should be provided on the second end portion 28. Such additional water plane area is provided in the form of buoyancy member 80 which is preferably provided with sufficient height, as shown in FIG. 9, to break the sea surface 52 when the structure 10 is sunk to the sea bed 48 and preferably has sufficient cross-sectional area, taken in a horizontal plane, at each portion of the buoyancy member 80 to break the surface 52 during sinking of the respective end portion of the structure 10 to maintain stability throughout the sinking of the respective end portion of the structure 10. The stability calculations for the sinking of the first end portion 26 may show that the platform 10 has stability throughout the process of sinking the first end portion 26 without the necessity of adding additional buoyancy moment. Thus, the first end portion of the platform is shown as not having been provided with any buoyancy member. However, the stability calculations may show that a buoyancy member is required on the first end portion 26 in which case a buoyancy member is provided on the first end portion 26 in accordance with this invention.

Figure 6:
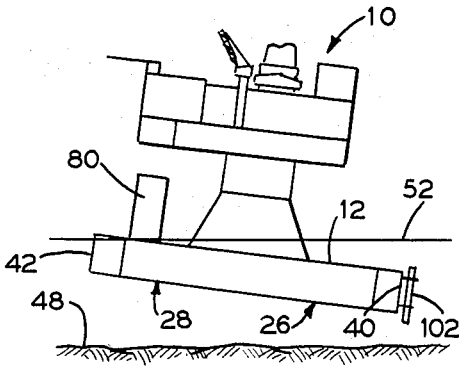

FIG. 6 illustrates the position of the platform as its first end portion 26 has been partially sunk to the sea bed 48. This is accomplished by flooding compartments 24 in the first end portion 26 as shown in FIGS. 1 and 2 with seawater or other ballast while the compartments 24 in the second end portion 28 are closed to ballasting. Thus, in accordance with the present invention, the first end portion 26 may be raised or lowered in a controlled manner by increasing the ballast in the compartments or removing ballast from the compartments of the first end portion 26.

Figure 7:
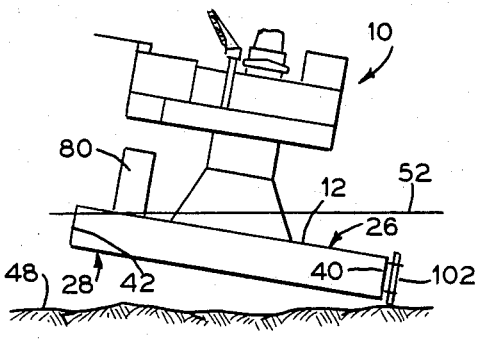

FIG. 7 illustrates the position of the platform 10 after the first end portion 26 has been sunk to the sea bed 48. Two or more pilings illustrated at 102 in FIGS. 2 and 7 have made contact with the sea bed 48 to prevent the base portion 12 of the platform from absorbing the force of impact and to maintain the base portion 12 out of contact with the sea bed 48 until after the second end portion 28 has been sunk to the sea bed 48 for purposes that will be more fully explained hereinafter.

Figure 8:
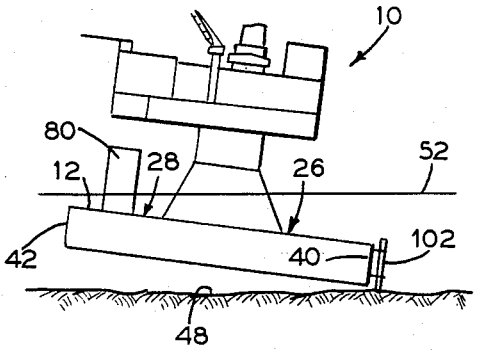

FIG. 8 illustrates a position of the platform 10 during sinking of the second end portion 28 to the sea bed 48. This is accomplished by ballasting the second end portion 28 of the structure by flooding the compartments 24 thereof with ballast. Again, the second end portion 28 may be raised and lowered in a controlled manner in accordance with the present invention by controlling the amount of ballast being pumped into or pumped out of the compartments 24. As shown in FIG. 8, additional buoyancy moment has been added on the second end portion 28 by the addition of buoyancy member 80 to provide stability throughout the sinking of the second end portion 28.

FIG. 9 illustrates the platform 10 after both end portions 26 and 28 have been sunk to the sea bed 48 and the pilings 102 have penetrated the sea bed 48.

Figure 10:
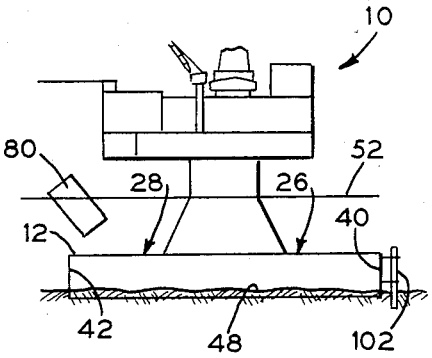

FIG. 10 illustrates the platform 10 embedded in the sea bed 48 after additional ballasting. Although the buoyancy member 80 may be removed from the base portion 12 as illustrated in FIG. 10 if the platform 10 is to be permanently installed in the sea bed 48, if the platform 10 is an exploration platform, it may be desirable to leave the buoyancy member 80 on the base portion 12 so that the platform 10 may be returned to the surface of the water with the platform 10 having stability at each position of its return to the surface so that it can be returned to the surface of the water in a controlled manner in accordance with the present invention.

Figure 11:
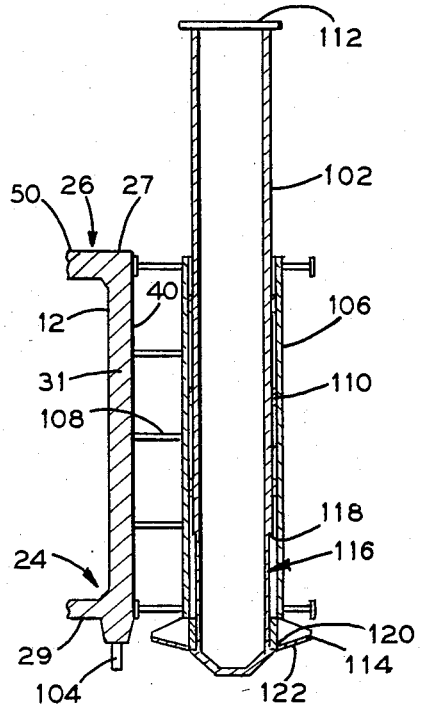
FIGS. 11 through 14 are sectional elevation views of a pile embodying this invention and illustrating consecutive stages of use of piles during the sinking of the structure.

Referring to FIG. 11, there is shown in detail the first end 40 of a structure 10. Extending downwardly from the bottom of the base portion 12 and extending around the perimeter thereof is a skirt 104 for enclosing the bottom of the structure 10 between lower members 29 and the sea bed 48 so that grout, which may be pumped therein to fill up voids between the lower members 29 and the sea bed 48, may be contained therein. This skirt 104 is subject to damage if it is caused to absorb the force of impact with the sea bed 48 or if the structure 10 is pivoted about the skirt 104 as a pivot point for sinking of the second end portion 28 of the structure to the sea bed 48. It is therefore desirable that the skirt 104 remain out of contact with the sea bed 48 until which time both end portions of the structure have been sunk to the sea bed 48. In order to achieve this objective, in accordance with an aspect of this invention there are attached at least two piles 102 such as the generally cylindrical elongate pinpile shown in FIG. 11 at the end of the structure 10 corresponding to the end portion thereof which is to be sunk to the sea bed 48 first. For example, as shown in FIG. 2, the structure 10 is provided with four such piles 102. The piles 102 are spaced over the width of the first end 40 of the structure 10. Each pile 102 is provided with an annular support housing 106 to enclose and fixedly engage the pile 102 in desired positions. Several support members 108 fixedly attach the housing 106 to the end 40 of the base 12. Means for positioning the piles 102 so that they may be elevated to the position shown in FIG. 11 are preferably provided so that the structure 10 may be constructed in a drydock and floated out in a minimum depth of water. Such means preferably comprise one or more annular clamps or inflatable members 110 between each piling 102 and its respective housing 106. Means such as an air pressure supply may be used to inflate these members 110 to fixedly engage the piling 102 in a desired position. Release of the inflation pressure accordingly will allow the pile to fall downwardly by gravity to the position shown in FIG. 12, with member 112 engaging the top of the housing 106 to act as a stop against further downward movement of the pile 102.

Figure 12:
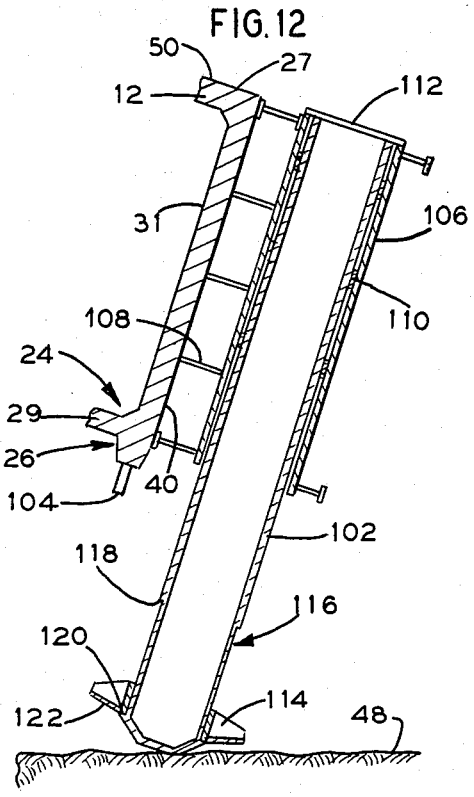

FIG. 12 illustrates the first end portion 26 of the platform making contact with the sea bed 48 by means of the pile 102 striking the sea bed. The pile clamps or inflatable members 110 at this point grip the pile 102 to prevent movement of the pile 102 in vertical directions relative to the skirt 104. The pile 102 extends downwardly beyond the skirt 104 to absorb the force of impact with the sea bed 48 and to maintain the skirt 104 out of contact with the sea bed 48 until after both end portions 26 and 28 of the platform have been sunk so that damage to the skirt may be avoided.

The piles 102 also serve to locate the position of the platform 10 on the sea bed 48 and to provide the pivot point 88 for sinking of the second end portion 28 of the platform. Referring back to FIG. 2, whether or not there is lateral stability during sinking of the first end portion to the sea bed 48 is not normally expected to be a problem since the base portion 12 will usually provide water plane surface over the entire width of the platform for sufficient restoring moment. After the first end portion 26 of the platform has been sunk to the sea bed 48, then the anchoring of the piles 102 to the sea bed 48 is expected to normally provide sufficient lateral stability during the sinking of the second end portion 28.

Figure 13:
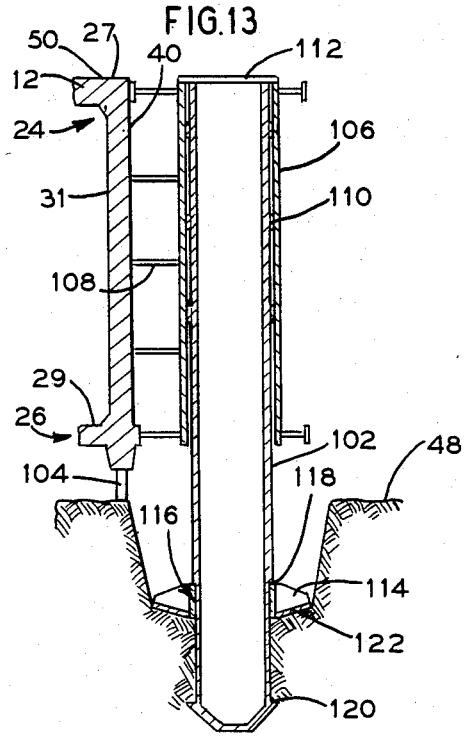

Each pile 102 is provided with a collar 114 which circumferentially engages the pile 102 to provide a horizontally extending surface 122 for limiting the depth of penetration of the pile 102 into the sea bed 48. The collar 114 is preferably slidable along the longitudinal axis of the bottom portion 116 of the pile 102 between two points illustrated at 118 and 120 at which points the outer diameter of the pile increases from a smaller diameter to a greater diameter to thereby act as stops for the collar which stops are both positioned on the pile 102 such as to be lower than the skirt 104 when the pile is positioned, as illustrated in FIG. 12, to prevent contact of the skirt 104 with the sea bed 48. As shown in FIG. 13, the pile 102 has penetrated the sea bed 48 as the collar 114 has slid or moved upwardly on the pile 102 until arrested by the stop 118 thereby providing a means for controlling the degree of penetration of the sea bed by the pile 102. The lower stop 120 is provided to allow positioning of the pile 102 with its lower end at substantially the same height as the skirt 104 as shown in FIG. 11 so that the structure 10 may be floated in a minimum depth of water. In FIG. 13, both end portions 26 and 28 of the platform have been sunk to the sea bed 48 and the piles 102 have penetrated the sea bed 48 such that the skirt 104 just touches the sea bed 48.

Figure 14:
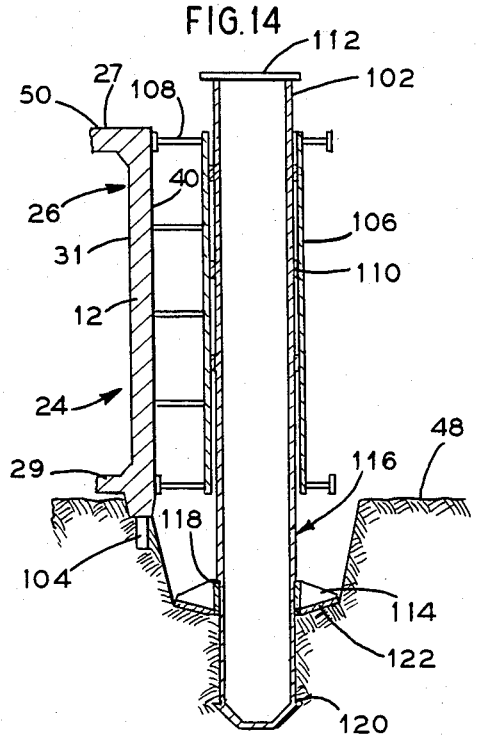

Referring to FIG. 14, the grip of the pile clamps or inflatable members 110 is released and the structure 10 is further ballasted for movement straight down so that the skirt 104 is displaced downwardly relative to the piles 102 and firmly penetrates the sea bed 48.

Certain features of this invention may sometimes be used to advantage without a corresponding use of the other features. It is also to be understood that the invention is by no means limited to the specific embodiments which have been illustrated and described herein, and that various modifications may indeed be made within the scope of the present invention as defined by the claims which are appended hereto.

I claim:

1. A method for sinking a structure having a first end portion and a second end portion to the sea bed comprising the steps of: a. ballasting said first end portion of the structure to sink said first end portion to the sea bed while said second end portion is closed to ballast; b. ballasting said second end portion of the structure, after said first end portion is sunk, to sink said second end portion to the sea bed; c. attaching at least one removable buoyancy member to the structure during at least one of steps a and b to maintain stability of the structure; d. attaching at least two piles at the end corresponding to said first end portion of the structure; e. spacing the piles over the length of said end; and f. fixedly positioning the piles vertically so that bottom portions thereof are lower than a skirt on the structure to absorb the force of impact of said first end portion with the sea bed and to maintain the skirt out of contact with the sea bed until both ends of the structure have been sunk to the sea bed.

2. A method according to claim 1 further comprising providing the buoyancy member with sufficient height when attached to the structure to break the sea surface when the structure is sunk to the sea bed.

3. A method according to any one of claims 1 or 2 wherein the step of attaching at least one buoyancy member comprises sizing and positioning the buoyancy member on the structure so that when calculating, prior to sinking of a respective end portion of the structure, for a series of positions of the structure in the range over which the respective end portion is to be sunk, the restoring moment due to additional water displaced when the respective end portion to be sunk is deflected from the respective position toward the sea bed by a small angle, and so that when comparing said restoring moments with the respective changes in mass moment and the respective changes in buoyancy moment of the water displacement before the respective deflections, the calculated restoring moments are greater than said respective changes in mass and buoyancy moments throughout the range of sinking positions.

4. A method for sinking a structure having a first end portion which terminates at a first end and a second end portion which terminates at a second end to the sea bed comprising attaching at least two piles to the structure at the first end of the structure, spacing the piles over the length of the first end, fixedly positioning the piles vertically so that bottom portions thereof are lower than a skirt on the structure, ballasting the first end portion of the structure while the second end portion is closed to ballast to sink the first end thereof to the sea bed while allowing the piles to absorb the force of impact of the first end with the sea bed and to maintain the skirt out of contact with the sea bed until both the first and second ends of the structure have been sunk to the sea bed, ballasting the structure to sink the second end thereof to the sea bed after the first end has been sunk to the sea bed, and releasing the piles so that they are free to move vertically relative to the skirt.

5. A method according to claim 4 further comprising attaching at least one buoyancy member on the structure during sinking of at least one of the first and second ends to the sea bed to maintain stability as said at least one of the first and second ends is sunk.

6. A method according to any one of claims 1 or 4 further comprising the step of disposing a collar about a pile to limit penetration depth of the pile into the sea bed.

7. A method according to any one of claims 1 or 4 further comprising the steps of elevating the piles for movement of the structure in shallow water, and transporting the structure to a selected site for sinking.

8. A method according to any one of claims 1 or 4 further comprising ballasting the structure while allowing the skirt to move downwardly relative to the piles and penetrate the sea bed.

9. In an offshore structure having a skirt for penetrating the sea bed upon sinking thereof to the sea bed, a first end portion which terminates at a first end, a second end portion which terminates at a second end, at least two piles attached to the structure at said first end of the structure and spaced-apart over the length of said first end, means for fixedly positioning said piles so that they extend downwardly beyond said skirt to absorb the force of impact of said first end with the sea bed and to maintain the skirt out of contact with the sea bed until both said first and second ends of the structure have been sunk to the sea bed, means for releasing said piles so that they are free to move vertically relative to the skirt, and means for sinking said first end portion without sinking said second end portion.

10. A structure according to claim 9 further comprising means for maintaining stability while sinking said first and second end portions.

11. A structure according to claim 9 further comprises at least one buoyancy member on the structure to maintain stability during sinking of at least one of said first and second end portions, said buoyancy member having a height when attached to the structure to break the sea surface when the structure is sunk.

12. A structure according to claim 9 wherein said pile positioning means comprises an annular member which surrounds an upper portion of a pile to position the pile vertically and at least one inflatable member between said annular member and said pile.

13. A structure according to claim 9 further comprising a collar extending circumferentially of said pile to provide a horizontally extending surface to limit the depth of penetration of the sea bed, said collar and a bottom portion of said pile positionable lower than the skirt for sinking of the structure.

14. A structure according to claim 13 further comprising means for elevating said piles for floating of the structure in shallow water.

15. A structure according to any one of claims 13 or 14 further comprising means for adjusting the height of said collar relative to said pile between a first position at the bottom end thereof and a second position which is above said first position and which is lower than the position of said skirt when said pile is in position for sinking of the structure.

16. A structure according to claim 15 wherein said collar height adjusting means comprises a stop at said first position and a stop at said second position, and said collar is slidably engaged to said pile for movement between said first and second positions.

17. A structure according to claim 11 wherein said means for maintaining stability comprises at least one buoyancy member which has a height when attached to the structure to break the sea surface when the structure is sunk.

18. A structure according to claim 12 or claim 17 wherein said buoyancy member is closed to the flow of seawater therein and has a cross-sectional area taken in a horizontal plane at each portion of the buoyancy member to break the sea surface during sinking of said at least one of said first and second end portions of the structure which is sufficient to maintain stability during sinking of said at least one of said first and second end portions.

* * * * *